US009273568B2

(12) United States Patent
Suzuki et al.

(10) Patent No.: US 9,273,568 B2
(45) Date of Patent: Mar. 1, 2016

(54) COUPLING STRUCTURE FOR VACUUM EXHAUST DEVICE AND VACUUM EXHAUST SYSTEM

(75) Inventors: Toshio Suzuki, Kanagawa (JP); Tomonari Tanaka, Kanagawa (JP); Kouji Shibayama, Kanagawa (JP); Masatomo Okamoto, Kanagawa (JP)

(73) Assignee: ULVAC, INC., Kanagawa (JP)

( * ) Notice: Subject to any disclaimer, the term of this patent is extended or adjusted under 35 U.S.C. 154(b) by 154 days.

(21) Appl. No.: 13/988,219

(22) PCT Filed: Nov. 16, 2011

(86) PCT No.: PCT/JP2011/006397

§ 371 (c)(1),
(2), (4) Date: Jun. 25, 2013

(87) PCT Pub. No.: WO2012/066782

PCT Pub. Date: May 24, 2012

(65) Prior Publication Data

US 2013/0280062 A1 Oct. 24, 2013

(30) Foreign Application Priority Data

Nov. 17, 2010 (JP) ..... 2010-257141

(51) Int. Cl.
*F03C 2/00* (2006.01)
*F03C 4/00* (2006.01)
(Continued)

(52) U.S. Cl.
CPC ..... *F01D 25/24* (2013.01); *F01C 21/007* (2013.01); *F01C 21/10* (2013.01); *F04C 2/084* (2013.01);
(Continued)

(58) Field of Classification Search
CPC ..... F04C 23/00; F04C 23/001; F04C 11/001; F04C 2/084; F04C 2/126; F04C 18/084; F04C 18/126; F01C 1/084; F01C 1/126
USPC ..... 418/9, 206.1–206.9, 149
See application file for complete search history.

(56) References Cited

U.S. PATENT DOCUMENTS 4,934,908 A * 6/1990 Turrell et al. ..... 418/9
4,971,529 A * 11/1990 Gannaway et al. ..... 418/60
(Continued)

FOREIGN PATENT DOCUMENTS

JP 03-145594 A 6/1991
JP 05-022333 U 3/1993
(Continued)

OTHER PUBLICATIONS

International Search Report in International Application No. PCT/JP2011/006397, filed Nov. 16, 2011.

*Primary Examiner* — Theresa Trieu
(74) *Attorney, Agent, or Firm* — Saliwanchik, Lloyd & Eisenschenk

(57) ABSTRACT

Provided is a coupling structure for vacuum exhaust devices each including a pump chamber and a casing that demarcates the pump chamber. The coupling structure includes a first end surface formed on a first side of the casing, and a second end surface formed on the second side of the casing, the second side being the opposite side of the first side. The casing of a first vacuum exhaust device and the casing of a second vacuum exhaust device among a plurality of vacuum exhaust devices are arranged to be directly superposed on each other such that the first end surface provided to the first vacuum exhaust device and the second end surface provided to the second vacuum exhaust device come into contact with each other. By fastening the first end surface and the second end surface, the first vacuum exhaust device and the second vacuum exhaust device are connected to each other such that gas can flow between the casing of the first vacuum exhaust device and the casing of the second vacuum exhaust device.

7 Claims, 11 Drawing Sheets

(51) Int. Cl.

| | |
|---|---|
| ***F04C 2/00*** | (2006.01) |
| ***F01D 25/24*** | (2006.01) |
| ***F04C 11/00*** | (2006.01) |
| ***F04C 2/12*** | (2006.01) |
| ***F04C 2/08*** | (2006.01) |
| ***F04C 23/00*** | (2006.01) |
| ***F01C 21/10*** | (2006.01) |
| ***F04C 25/02*** | (2006.01) |
| ***F01C 21/00*** | (2006.01) |
| *F01C 1/12* | (2006.01) |
| *F01C 1/08* | (2006.01) |
| *F04C 18/12* | (2006.01) |

(52) U.S. Cl.
CPC ..... *F04C 2/126* (2013.01); *F04C 11/001* (2013.01); *F04C 23/00* (2013.01); *F04C 23/001* (2013.01); *F04C 25/02* (2013.01); *F01C 1/084* (2013.01); *F01C 1/126* (2013.01); *F04C 18/126* (2013.01)

(56) References Cited

U.S. PATENT DOCUMENTS

| | | | | |
|---|---|---|---|---|
| 2004/0081565 | A1 | 4/2004 | Kuramoto et al. | |
| 2007/0104587 | A1* | 5/2007 | Kawamura et al. ..... | 417/410.4 |

FOREIGN PATENT DOCUMENTS

| | | | |
|---|---|---|---|
| JP | 09-502001 | A | 2/1997 |
| JP | 2002-364569 | A | 12/2002 |
| JP | 2004-100594 | A | 4/2004 |
| JP | 2010-138725 | A | 6/2010 |
| WO | WO-2008/152713 | A1 | 12/2008 |

* cited by examiner

COUPLING STRUCTURE FOR VACUUM EXHAUST DEVICE AND VACUUM EXHAUST SYSTEM

CROSS-REFERENCE TO RELATED APPLICATIONS

This application is the U.S. national stage application of International Patent Application No. PCT/JP2011/006397, filed Nov. 16, 2011, which claims priority to Japanese Application No. 2010-257141, filed Nov. 17, 2010, the disclosures of each of which are incorporated herein by reference in their entirety.

TECHNICAL FIELD

The present invention relates to a coupling structure for vacuum exhaust devices, in which a plurality of vacuum exhaust devices that depressurize and exhaust a device to be exhausted such as a vacuum chamber are coupled to one another, and to a vacuum exhaust system provided, to the coupling structure.

This application claims priority based on Japanese Patent Application No 2010-257141, filed in the Japan Patent Office on Nov. 17, 2010, the content of which is incorporated herein by reference.

BACKGROUND ART

In a vacuum exhaust device (vacuum pump) used for depressurizing and exhausting a device to be exhausted such as a vacuum chamber, it is general to connect a plurality of vacuum exhaust devices, which are different depending on the intended use, to one another in series such that gas can flow, thus achieving target performance. For example, a mechanical booster pump is adopted as a main pump for exhausting a device to be exhausted to an operating pressure and maintaining the pressure, and an oil rotary pump or a dry pump is adopted as a roughing pump for exhausting a vacuum system from an, atmospheric pressure to a pressure at which the main pump is capable of operating. Those vacuum pumps are used in combination, thus establishing a vacuum exhaust system with which target performance is achieved. The combination of vacuum pumps is not limited thereto and is diverse. There is a case where three or more vacuum pumps are combined.

In the case where such a plurality of vacuum pumps are combined, the respective vacuum pumps are generally arranged at proper positions and then connected to one another by a connection pipe or the like. For example, a connection structure in which each vacuum pump is fixed to a predetermined frame (installation base) and an exhaust port of the main pump and an intake port of the roughing pump are connected to each other with use of a pipe is generally used.

For example, Non-patent Document 1 below describes a vacuum exhaust system in which an exhaust port of an upper pump and an intake port of a lower pump are connected to each other with use of a pipe. Further, Non-patent Document 2 below describes a vacuum exhaust system in which vacuum pumps are installed on and within a frame and an exhaust port and an intake port of upper and lower vacuum pumps are connected to each other with use of a pipe.

Further, for vacuum pumps connected by the method as described above, widely used is a multistage roots vacuum pump having a multistage structure in which a space formed within a single casing is partitioned to form a plurality of pump chambers. In the multistage roots vacuum pump, it is general to connect pump chambers at respective stages in series (see Patent Document 1 below).

Patent Document 1: Japanese Patent Application Laid-open No 2002-364569

Non-patent Document 1: "Edwards vacuum product catalog Revision 3". Edwards Japan Limited, p. 54

Non-patent Document 2: "Vacuum Technology and Innovative Ideas (ULVAC): Oil Rotary Vacuum Pump System, YM-VD/YM-VS Series (1580 L/min to 20000 L/min)", [online], ULVAC, Inc., [retrieved on Apr. 16, 2010], Internet <URL: http://www.ulvac.co.jp/products/compo/F020006.html>

DISCLOSURE OF THE INVENTION

Problem to be Solved by the Invention

Incidentally, in the conventional vacuum exhaust system as described above, in general, the vacuum pumps are individually designed and manufactured except for some specifications such as connection specifications of an exhaust port and an intake port. In the case where such vacuum pumps are installed, in order to effectively use a limited installation space, it is required to make an installation area for installing the vacuum exhaust system as small as possible. Further, as a frame used for installation, it is required to use a frame that is simplified as much as possible and has durability. Furthermore, in order to minimize a pressure loss, pipes to connect the vacuum pumps are required to be short and thick and to be connected so as not to bent.

However, it has been difficult to meet those demands at the same time mainly in view of costs. For example, in consideration of costs, the frame has had to be provided with an enough dimension to support various shapes of vacuum pumps. Further, it has been, impossible to effectively use a limited installation space, for example, the installation area is increased depending on the frame even though the vacuum pump is downsized.

The present invention has been made in view of the circumstances as described above, and it is an object of the present invention to provide a vacuum exhaust device capable of achieving space-saving and cost reduction.

Means for Solving the Problem

In order to achieve the object described above, the present invention provides the following means.

A coupling structure for vacuum exhaust devices according to an embodiment of the present invention is a coupling structure for vacuum exhaust devices each including a pump chamber and a casing that demarcates the pump chamber.

Each of the vacuum exhaust devices includes a motor connected to the casing.

The coupling structure includes a first end surface formed on a first side of the casing and a second end surface formed on a second side of the casing, the second side being the opposite side of the first side.

The casing of a first vacuum exhaust device and the casing of a second vacuum exhaust device among a plurality of vacuum exhaust devices are arranged to be directly superposed on each other such that the second end surface provided to the first vacuum exhaust device and the first end surface provided to the second vacuum exhaust device come into contact with each other.

By fastening the first end surface and the second end surface, the first vacuum exhaust device and the second vacuum exhaust device are connected to each other such that gas can flow between the casing of the first vacuum exhaust device and the casing of the second vacuum exhaust device.

The plurality of vacuum exhaust devices may each include an intake unit and an exhaust unit.

The intake unit includes at least one intake port and an intake unit end surface, the at least one intake port communicating with the pump chamber, and is formed on the first side of the casing.

The exhaust unit includes at least one exhaust port and an exhaust unit end surface, the at least one exhaust port communicating with the pump chamber, and is formed on the second side of the casing.

The casing of the first vacuum exhaust device and the casing of the second vacuum exhaust device are arranged to be directly superposed on each other such that the intake unit, end surface of the intake unit and the exhaust unit end surface of the exhaust unit come into contact with and overlap each other.

By fastening the first end surface and the second end surface, the intake unit end surface and the exhaust, unit end surface are directly connected to each other and the intake port and the exhaust port communicate with each other.

The coupling structure may further include a plurality of mount portions and a plurality of leg portions.

The plurality of mount portions each include the first end surface and are each formed on the first side of the casing.

The plurality of leg portions each include the second end surface and are each formed on the second side of the casing.

The plurality of mount portions and the intake unit may be independently formed on the casing. Further, the plurality of leg portions and the exhaust unit may be independently formed on the casing.

The intake unit end surface of the intake unit and the plurality of mount portions may be formed on the same plane. Further, the exhaust unit end surface of the exhaust unit and the plurality of leg portions may be formed on the same plane.

The coupling structure may further include a sealing member provided to the intake unit end surface or the exhaust unit end surface, the sealing member keeping air sealing inside the casing.

The coupling structure may further include a positioning mechanism provided to the first end surface of each of the plurality of mount portions or the second end surface of each of the plurality of leg portions, the positioning mechanism having a concavo-convex shape.

The casing may be formed of a lower-side casing and an upper-side casing that can be divided into two in a vertical direction.

A vacuum exhaust system according to an embodiment of the present invention is a vacuum exhaust system including a plurality of connected vacuum exhaust devices, the plurality of vacuum exhaust devices each including a pump chamber and a casing that demarcates the pump chamber.

The casing includes a first end surface formed on a first side of the casing and a second end surface formed on a second side of the casing, the second side being the opposite side of the first side.

The casing of a first vacuum exhaust device and the casing of a second vacuum exhaust device among a plurality of vacuum exhaust devices are arranged to be directly superposed on each other such that the second end surface provided to the first vacuum exhaust device and the first end surface provided to the second vacuum exhaust device come into contact with each other.

By fastening the first end surface and the second end surface, the first vacuum exhaust device and the second vacuum exhaust device are connected to each other such that gas can flow between the casing of the first vacuum exhaust device and the casing of the second vacuum exhaust device.

The vacuum exhaust system may further include a connection unit and a cooling mechanism provided at least to the connection unit.

The connection unit is provided to the outside of the casing of each of the plurality of vacuum exhaust devices and causes, among the plurality of vacuum exhaust devices, the pump chamber provided to one of vacuum exhaust devices at subsequent stages after a vacuum exhaust device at a foremost stage and the pump chamber provided to a vacuum exhaust device at a last stage to communicate with each other, the vacuum exhaust device at the foremost stage being connected to a device to be vacuum-exhausted.

The plurality of vacuum exhaust devices may each include an intake unit and an exhaust unit.

The intake unit includes at least one intake port and an intake unit end surface, the at least one intake port communicating with the pump chamber, and is formed on the first side of the casing.

The exhaust unit includes at least one exhaust port and an exhaust unit end surface, the at least one exhaust port communicating with the pump chamber, and is formed on the second side of the casing.

The casing of the first vacuum exhaust device and the casing of the second vacuum exhaust device are arranged to be directly superposed on each other such that the intake unit end surface of the intake unit and the exhaust unit end surface of the exhaust unit come into contact with and overlap each other.

By fastening the first end surface and the second end surface, the intake unit end surface and the exhaust unit end surface are directly connected to each other and the intake port and the exhaust port communicate with each other.

The connection unit may include an intake-side-path-forming member, an exhaust-side-path-forming member, and a pipe member.

The intake-side-path-forming member includes an intake-side path that communicates with the intake port of the first vacuum exhaust device, the intake-side-path-forming member being connected to the casing of the first vacuum exhaust device.

The exhaust-side-path-forming member includes an exhaust-side path that communicates with the exhaust port of the second vacuum exhaust device, the exhaust-side-path-forming member being connected to the casing of the second vacuum exhaust device.

The pipe member includes a pipe path that communicates with the intake-side path and the exhaust-side path, the pipe member being connected to the intake-side-path-forming member and the exhaust-side-path-forming member.

The cooling mechanism may be provided to at least one of the exhaust-side-path-forming member and the pipe member.

The plurality of vacuum exhaust devices may be arranged to be stacked on each other. In this case, the exhaust-side-path-forming member is arranged at a lower portion of the vacuum exhaust device at the last stage, the lower portion being a lowermost portion of the plurality of vacuum exhaust devices.

The connection unit may cause the pump chamber of the first vacuum exhaust device and the pump chamber of the second vacuum exhaust device to communicate with each other.

At least one of the plurality of vacuum exhaust devices may include a partition wall formed within the casing such that a plurality of pump chambers are defined within the casing of the at least, one vacuum exhaust device. The cooling mechanism may further be provided to the partition wall.

Effect of the Invention

According to the embodiments of the present invention, since the casings of the vacuum exhaust devices can be directly coupled to each other without using a frame or the like, it is possible to provide a vacuum exhaust device capable of achieving space-saving and cost reduction.

Further, since the casings of the vacuum exhaust devices are connected to each other, the rigidity of the whole system constituted of a plurality of vacuum exhaust devices is improved, and heat radiated from the vacuum exhaust devices can be dissipated.

MODE(S) FOR CARRYING OUT THE INVENTION

First Embodiment

Figure 1:
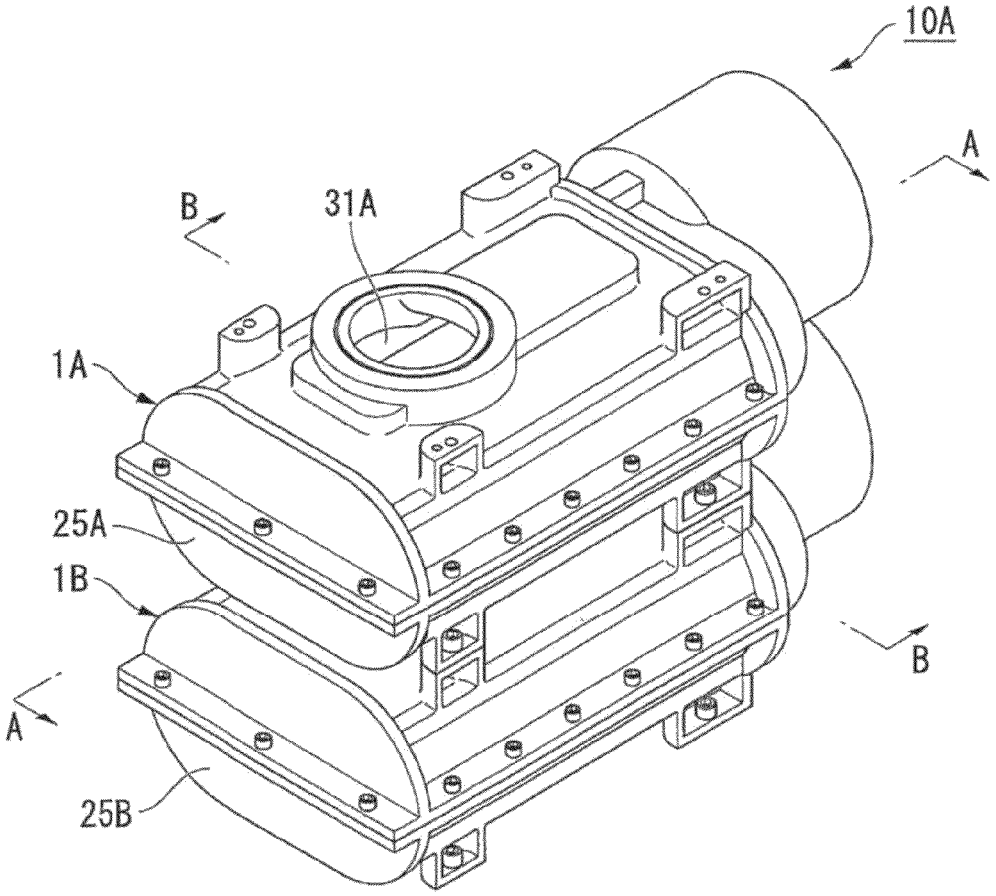
FIG. 1 is a perspective view of a vacuum exhaust system according to a first embodiment of the present invention as viewed from above.

Hereinafter, detailed description will be given on a vacuum exhaust system 10A with reference to the drawings, the vacuum exhaust system 10A adopting a coupling structure for vacuum exhaust devices according to a first embodiment of the present invention. As shown in FIG. 1, the vacuum exhaust system 10A of this embodiment is a system in which two vacuum exhaust devices 1A and 1B are coupled to each other. The vacuum exhaust system 10A is a system in which gas taken in from an intake port 31A of the vacuum exhaust device 1A connected to a device to be exhausted such as a vacuum chamber (not shown) is compressed by the two vacuum exhaust devices 1A and 1B and exhausted from an exhaust port 41B (see FIG. 5) of the vacuum exhaust device 1B.

The vacuum exhaust devices 1A and 1B constituting the vacuum exhaust system 10A each have a casing as a constituent element, the casing having substantially the same outer shape. Further, the vacuum exhaust device 1A (first vacuum exhaust device) can be arranged to be directly superposed on the vacuum exhaust device 1B (second vacuum exhaust device) on a plane denoted by a reference symbol E (see FIG. 5).

Further, the vacuum exhaust device 1A is arranged to be superposed on the vacuum exhaust device 1B so as to be stacked in an up-and-down direction (vertical direction), and thus an exhaust port 41A of the vacuum exhaust device 1A on the upper side (see FIG. 5) and an intake port 31B of the vacuum exhaust device 1B on the lower side can be directly connected to each other without a pipe.

Hereinafter, detailed description will be given on each of the vacuum exhaust devices 1A and 1B. The vacuum exhaust device 1A and the vacuum exhaust device 1B have substantially the same configuration, and therefore the vacuum exhaust device 1B will be described.

Figure 2:
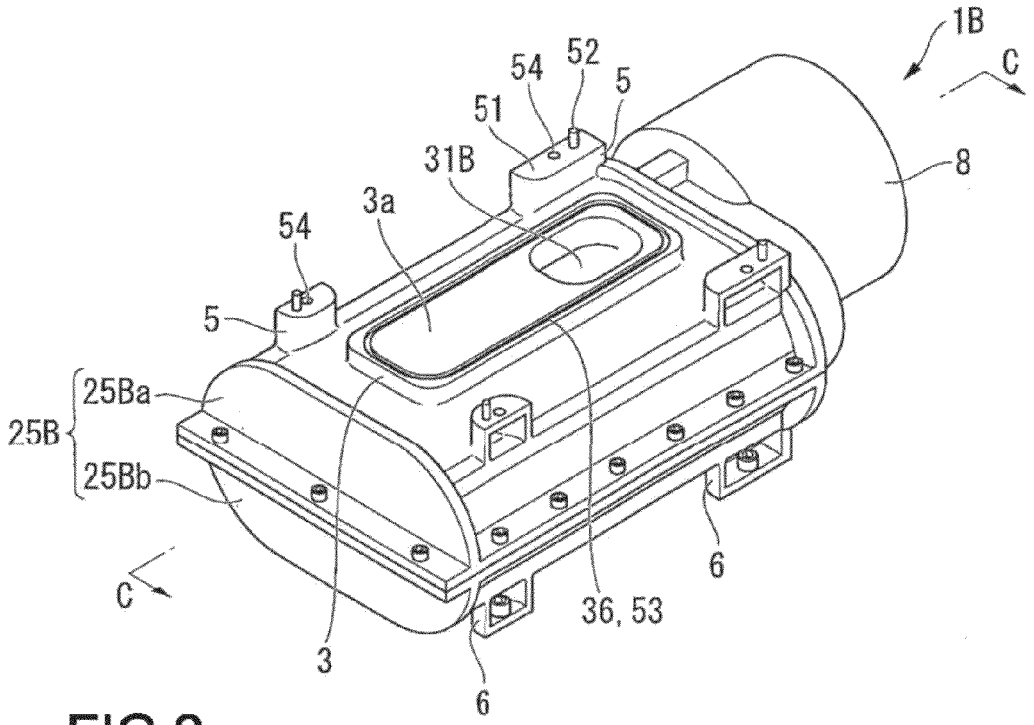
FIG. 2 is a perspective view of a vacuum exhaust device according to the first embodiment as viewed from above.
Figure 3:
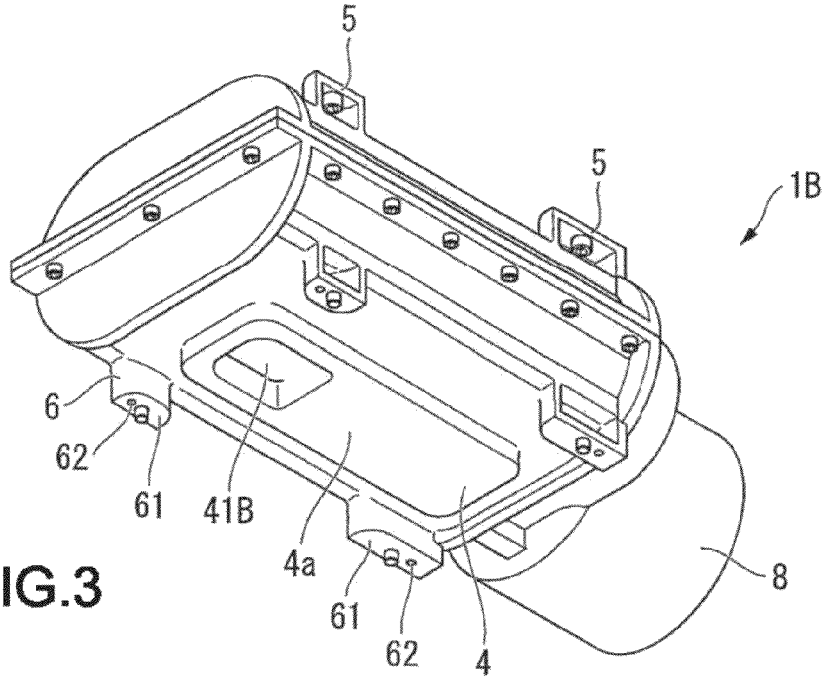
FIG. 3 is a perspective view of the vacuum exhaust device as viewed from below.
Figure 4:
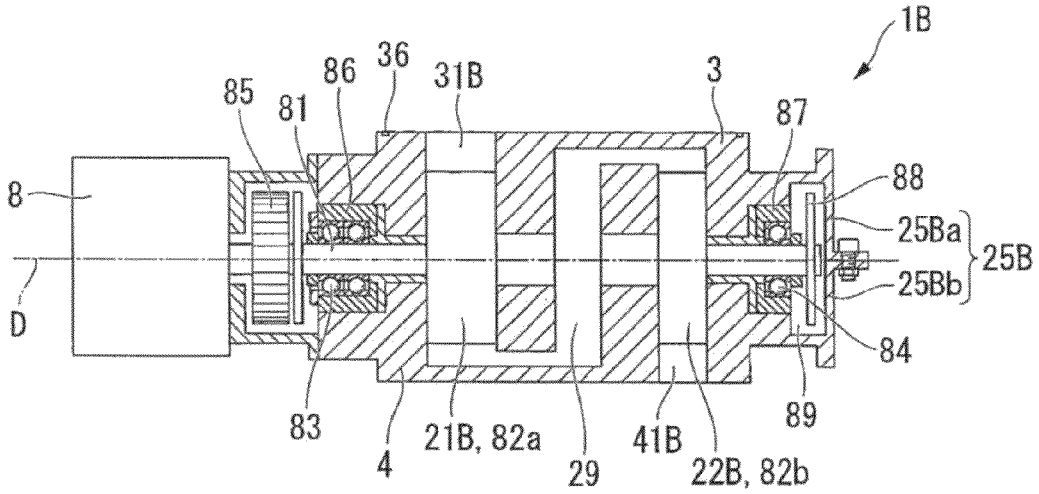
FIG. 4 is a cross-sectional view of the vacuum exhaust device taken along the line C-C of FIG. 2.
Figure 6:
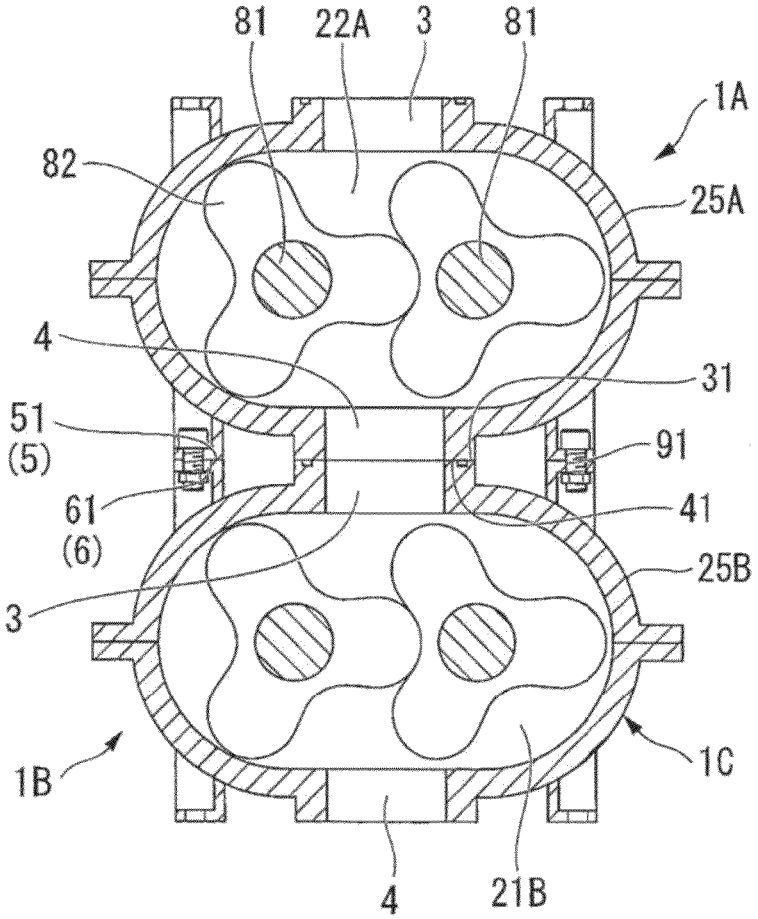
FIG. 6 is a cross-sectional view of the vacuum exhaust system taken along the line B-B of FIG. 1.

As shown in FIGS. 2 to 4, the vacuum exhaust device 1B is, a roots vacuum pump including a casing 25B constituted of an upper-side casing 25Ba and a lower-side casing 25Bb, two rotating shafts 81 and 81 (see FIG. 6), cocoon-shaped rotors 82*a* and 82*b* that are housed in two pump chambers 21B and 22B, respectively, the pump chambers 21B and 22B being demarcated by the casing 25B, and a motor 8 that drives the rotating shafts 81 and 81.

The rotors 82*a* and 82*b* are each constituted of a pair of rotors. The two rotors are arrayed on the respective rotating shafts 81 and housed in the pump chambers 21B and 22B. The pair of rotors are synchronously rotated in different directions by a drive gear 85 provided at a shaft end of each rotating shaft 81.

The casing 25B demarcates the two pump chambers 21B and 22B and also forms the outer shape of the vacuum exhaust device 1B. Further, the rotating shafts 81 and 81 are supported by bearings 83 and 84.

The pump chamber 21B and the pump chamber 22B are directly connected to each other via a connection pipe 29 on the inside of the casing 25B constituting the vacuum exhaust device 1B. The pump chamber 21B communicates with the intake port 31B formed at an upper portion of the casing 25B. The pump chamber 22B communicates with the exhaust port 41B formed at a lower portion of the casing 25B.

Next, description will be given on the casing 25B constituting the vacuum exhaust device 1B. The casing 25B has a vertically dual-partitioning structure as will be described later, in which an intake unit 3 including the intake port 31B is formed in an upper portion (first side), and an exhaust unit 4 including the exhaust port 41B is formed in the lower portion (second side). Further, four mount portions 5 are formed in the upper portion (first side) of the casing 25B, and four leg portions 6 are formed in the lower portion (second side).

The casing 25B has an elliptical cylinder shape that depends on the shape of the pump chambers 21B and 22B. The intake unit 3, the exhaust unit 4, the mount portions 5, and the leg portions 6 are formed integrally with the casing 25B.

Specifically, it is preferable to form the intake unit 3, the exhaust unit 4, the mount portions 5, and the leg portions 6 integrally by molding.

The vacuum exhaust device 1B is provided such that the longitudinal direction of the casing 25B (axial direction of the rotating shaft 81) is horizontal. It should be noted that in the following description, the plane including the two rotating shafts 81 is referred to as a horizontal center plane (denoted by D in FIG. 4).

The casing 25B is divided into two of the upper-side casing 25Ba and the lower-side casing 25Bb. The upper-side casing 25Ba and the lower-side casing 25Bb are fastened with fastener members such as a bolt and a nut and are configured so as to be capable of holding a bearing case 86 on the motor 8 side and a bearing case 87 on the other side of the motor side by the combination of the upper- and lower-side casings 25Ba and 25Bb. Further, the combination of the upper- and lower-side casings 25Ba and 25Bb allows a space 89 including the bearing 84 located on the other side of the motor side and an oil scrape-up blade 88 to be hermetically sealed. It should be noted that in this embodiment, the division plane substantially coincides with the horizontal center plane D.

The intake unit 3 is formed in the upper portion of the casing 25B so as to upwardly protrude and formed integrally with the casing 25B (upper-side casing 25Ba). The intake unit 3 includes an end surface (intake unit end surface) 3*a* that is parallel to the horizontal center plane D described above. This end surface 3*a* has a substantially rectangular shape that is long in the longitudinal direction of the casing 25B.

Further, the intake unit 3 is provided with the intake port 31B. The intake port 31B is opened on the end surface 3*a* and communicates with the pump chamber 21B. Furthermore, a groove 36 is formed along the outer shape of the end surface 3*a* on a slightly inner side of the end surface 3*a* of the intake unit 3. An O-ring 53 (sealing member) is fitted into the groove 36.

The exhaust unit 4 is formed in the lower portion of the casing 25B so as to downwardly protrude and formed integrally with the casing 25B (lower-side casing 25Bb). Similarly to the intake unit 3, the exhaust unit 4 includes an end surface (exhaust unit end surface) 4*a* that is parallel to the horizontal center plane D. The exhaust unit 4 is provided with the exhaust port 41B. The exhaust port 41B is opened on the end surface 4*a* and communicates with the pump chamber 22B.

The end surface 3*a* of the intake unit 3 and the end surface 4*a* of the <exhaust unit 4 have substantially the same shape in plan view.

The mount portions 5 serve as the upper portion of the casing 25B (upper-side casing 25Ba) and are protrusion-like mounts that are provided at four outermost positions in plan view. The mount portions 5 each have such a protrusion-like shape that protrudes upwardly from the vacuum exhaust device 1B. An upper end of each of the four mount portions 5 forms a surface 51 (hereinafter, referred to as first end surface 51). The four first end surfaces 51 are formed on the same plane.

Further, the first end surfaces 51 of the mount portions 5 and the end surface 3*a* of the intake unit 3 described above are formed on the same plane. However, the mount portions 5 are provided independently of the intake unit 3. In other words, the first end surfaces 51 of the mount portions 5 and the end surface 3*a* of the intake unit 3 are formed separate from each other.

The leg portions 6 serve as the lower portion of the casing 25B (lower-side casing 25Bb) and are protrusion-like legs that are provided at four outermost positions in plan view. The leg portions 6 each have such a protrusion-like shape that protrudes downwardly from the vacuum exhaust device 1B. Further, the positions in plan view are substantially the same as those of the mount portions 5. A lower end of each of the four leg portions 6 forms a surface 61 (hereinafter, referred to as second end surface 61). The four second end surfaces 61 are formed on the same plane.

Further, the end surfaces 61 of the leg portions 6 and the end surface 4*a* of the exhaust unit 4 are formed on the same plane. However, the leg portions 6 are provided independently of the exhaust port 4. In other words, the end surfaces 61 of the leg portions 6 and the end surface 4*a* of the exhaust unit 4 are formed separate from each other.

Moreover, each of the mount portions 5 and leg portions 6 is formed to be hollow with a side surface being as an open surface, and the end surfaces 51 and 61 are provided with fastening holes (positioning holes) 54 and 62, respectively.

Further, as shown in FIGS. 2 and 3, the mount portion 5 is provided with a protrusion portion 52 (positioning mechanism). In response to this, the leg portion 6 is provided with a positioning hole 62 (positioning mechanism).

Figure 5:
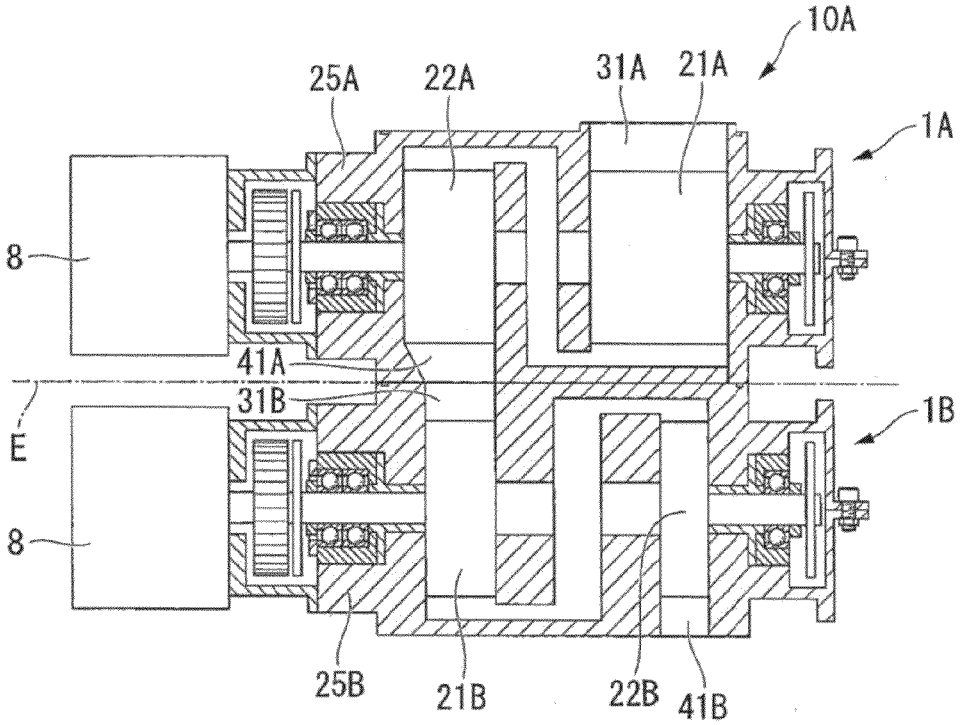
FIG. 5 is a cross-sectional view of the vacuum exhaust system taken along the line A-A of FIG. 1.

It should be noted that as shown in FIG. 5, the vacuum exhaust device 1A has substantially the same configuration as that of the vacuum exhaust device 1B except for the arrangement of the pump chambers 21A and 22A.

As shown in FIG. 5, the vacuum exhaust system 10A is a system in which the vacuum exhaust device 1A is directly superposed on the vacuum exhaust device 1B. In this case, the vacuum exhaust device 1A is superposed on the vacuum exhaust device 1B such that the end surface 3*a* of the intake unit 3 of the vacuum exhaust device 1B and an end surface 4*a* of the exhaust unit 4 of the vacuum exhaust device 1A come into contact with each other. Further, the exhaust port 41A of the vacuum exhaust device 1A and the intake port 31B of the vacuum exhaust device 1B are formed at the same position in plan view.

According to the embodiment described above, the vacuum exhaust devices 1A and 1B can be arranged to be directly superposed on each other in the up-and-down direction on the plane denoted by reference symbol E (see FIG. 5), and the vacuum exhaust device 1A can be placed immediately above the vacuum exhaust device 1B such that the end surface 4*a* of the exhaust port 4 of the vacuum exhaust device 1A comes into contact with and overlaps the end surface 3*a* of the intake unit 3 of the vacuum exhaust device 1B. Thus, the exhaust port 41A of the vacuum exhaust device 1A and the intake port 31B of the vacuum exhaust device 1B can communicate with each other such that gas can flow.

In other words, gas that flows in from the intake port 31A of the vacuum exhaust device 1A is compressed in the pump chambers 21A and 22A and exhausted from the exhaust port 41A. Then, the gas is compressed in the pump chambers 21B and 22B via the intake port 31B of the vacuum exhaust device 1B and exhausted from the exhaust port 41B. In the compression, the gas is trapped in a space between the casing 25 and the rotor 82 and exhausted to the exhaust side by the rotation of the rotor 82.

Thus, it is unnecessary to provide a pipe that connects the vacuum exhaust devices 1A and 1B to each other, and since a distance between the coupled pump chambers becomes short, it is possible to suppress a pressure loss.

Since the casings 25A and 25B constituting the vacuum exhaust devices 1A and 1B are connected to each other, the rigidity of the whole system constituted of a plurality of vacuum exhaust devices is improved, and heat radiated from the vacuum exhaust devices 1A and 1B can be dissipated.

Further, the casing 25 is provided with the configuration in which the upper and lower casings 25*a* and 25*b* are combined with each other to hold the bearing cases 86 and 87 and to form the space 89 on the opposite side of the motor side (to serve as cover). Thus, it is possible to reduce the number of components and suppress deformation of the vacuum exhaust devices 1A and 1B at a time of an exhaust operation because the whole casing 25 holds the bearing cases 86 and 87.

Further, since the first end surfaces 51 of the mount portions 5 and the second end surfaces 61 of the leg portions 6 are formed at, substantially the same positions in plan view, the first end surfaces 51 of the mount portions 5 and the second end surfaces 61 of the leg portions 6 can come into contact with and overlap each other by arranging the vacuum exhaust device 1A and the vacuum exhaust device 1B in the up-and-down direction. In this state, the mount portions 5 and the leg portions 6 are fastened with the fastener member 91 such as a bolt and a nut, which makes it possible to reliably fix the vacuum exhaust device 1A and the vacuum exhaust device 1B.

By arrangement of the sealing member such as the O-ring 53 in the groove 36 formed on the end surface 3*a* of the intake unit 3, an airtight state when the intake unit 3 and the exhaust unit 4 are connected can be improved.

It should be noted that the groove 36 may be provided not on the intake unit 3 side but on the exhaust unit 4 side (in this case, on the exhaust unit side of the casing 25A of the vacuum exhaust device 1A).

When the vacuum exhaust devices 1A and 1B are coupled to each other, the protrusion portion 52 of the mount portion 5 and the positioning hole 62 of the leg portion 6 are fitted to each other so that positioning can be easily performed. The protrusion portion 52 and the positioning hole 62 are preferably provided to all of the leg portions 6 and the mount portions 5, but may be provided to at least two of the protrusion portions 52 and of the positioning holes 62.

It should be noted that the number of pump chambers demarcated within the casing 25 may be one or three or more and can be freely set depending on the specifications.

Further, the vacuum exhaust device is not limited to the above-mentioned roots vacuum pump, and any vacuum pump may be adopted as long as it is a vacuum pump having the same structure including an intake port and an exhaust port in a casing.

Further, in this embodiment, the four mount portions 5 and the four leg portions 6 are provided, but the structure is not limited thereto. Any structure may be adopted as long as the mount portion 5 can reliably support the leg portion 6.

Moreover, if the mount portion 5 can reliably support the leg portion 6, the first end surface 51 of the mount portion 5 and the end surface 3*a* of the intake unit 3 may be formed integrally with each other, without being formed separated from each other. In the same way, the second end surface 61 of the leg portion 6 and the end surface 4*a* of the exhaust unit 4 may also be formed integrally with each other.

Second Embodiment

Figure 7:
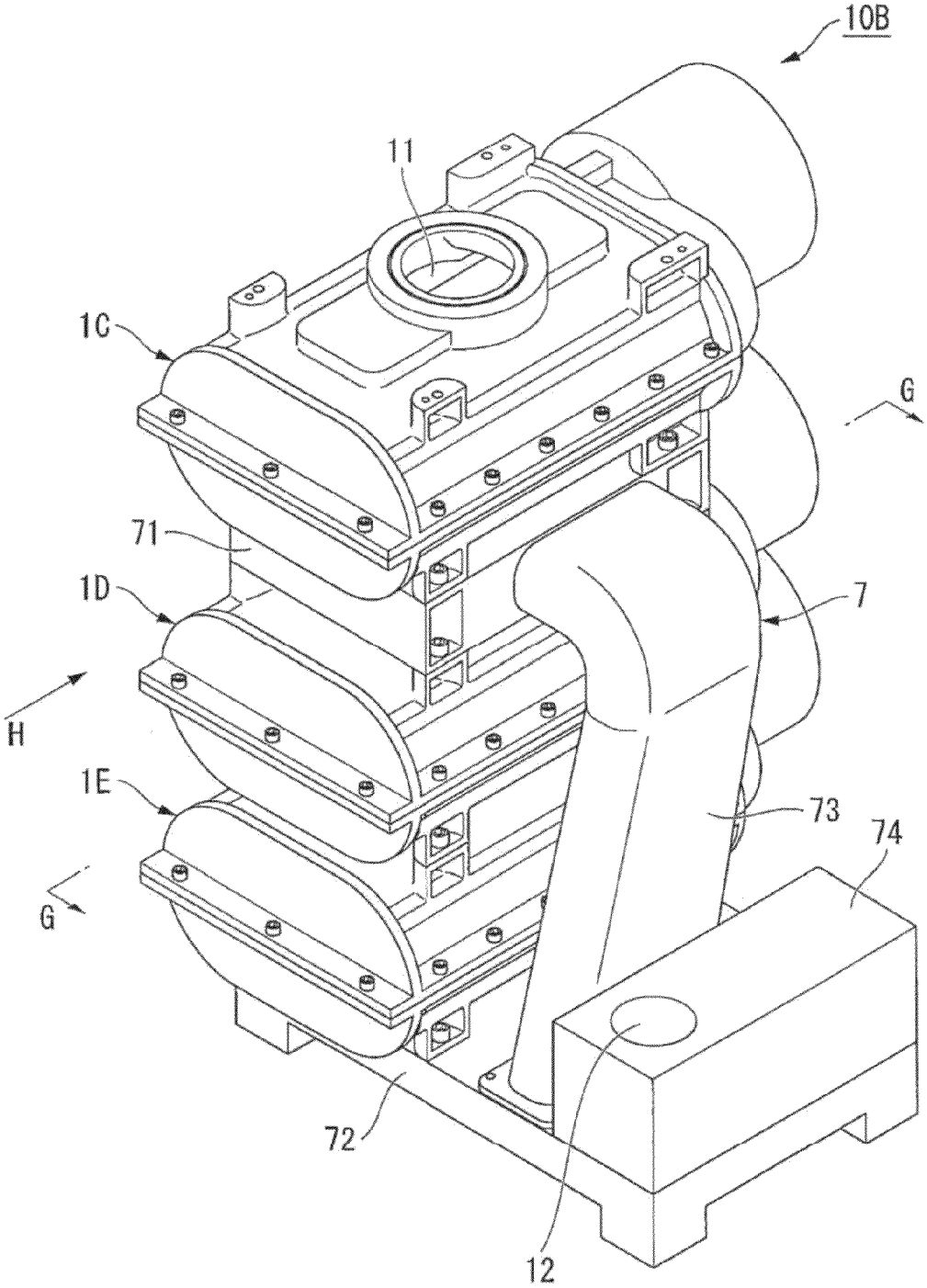
FIG. 7 is a perspective view of a vacuum exhaust system according to a second embodiment of the present invention as viewed from above.

Next, detailed description will be given on a vacuum exhaust system 10B according to a second embodiment of the present invention with reference to the drawings. As shown in FIG. 7, the vacuum exhaust system 10B is a system in which gas taken in from an intake port 11 connected to a device to be exhausted such as a vacuum chamber (not shown) is compressed by three vacuum exhaust devices 1C, 1D, and 1E and exhausted from an exhaust port 12.

Figure 8:
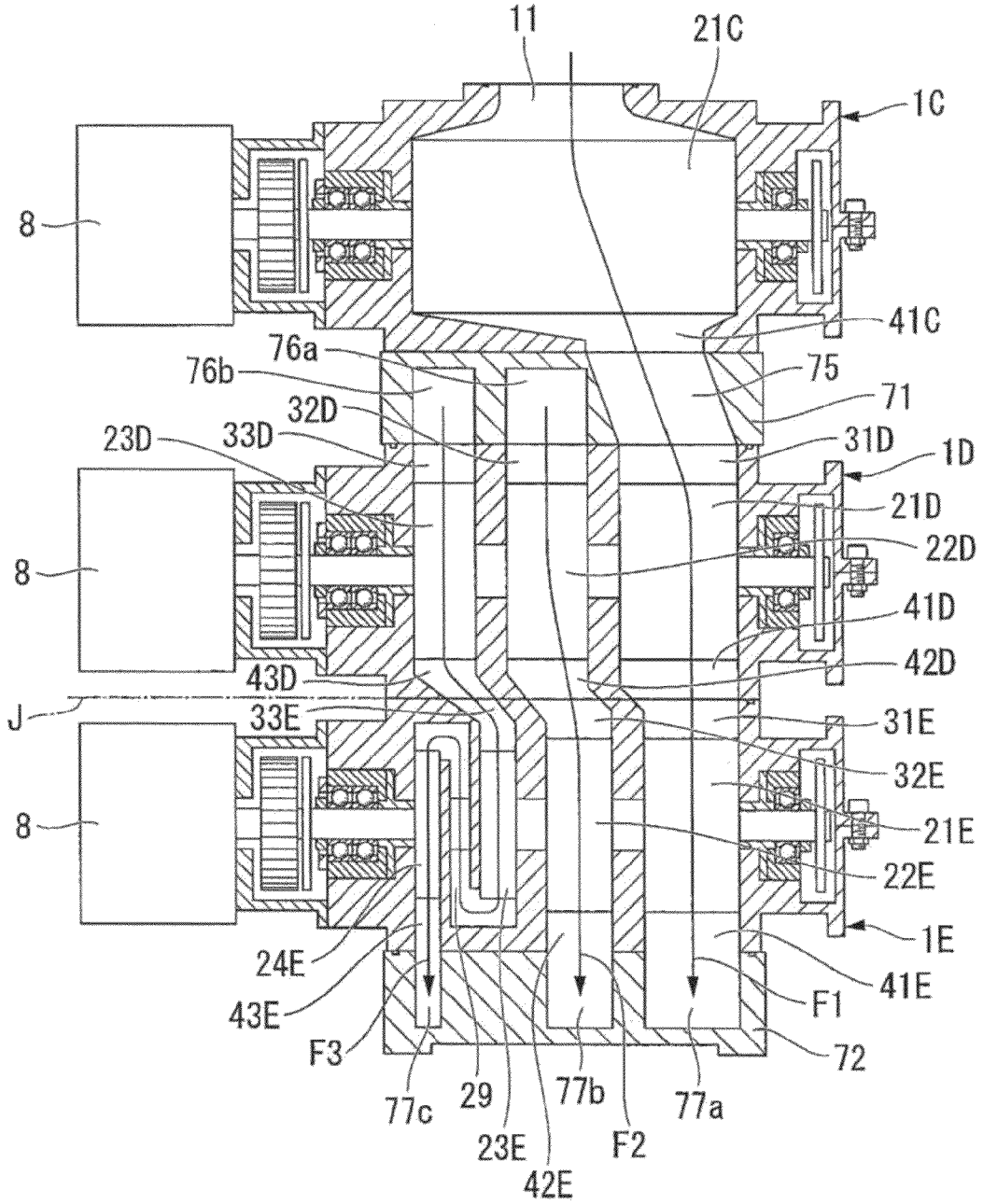
FIG. 8 is a cross-sectional view of the vacuum exhaust system taken along the line G-G of FIG. 7.

As shown in FIGS. 7 and 8, the vacuum exhaust devices 1C, 1D, and 1E constituting the vacuum exhaust system 10B can be arranged to be directly superposed on one another. Specifically, casings constituting the vacuum exhaust devices 1C, 1D, and 1E can be directly connected to one another.

As shown in FIG. 8, among the three vacuum exhaust devices 1C to 1E, the vacuum exhaust device 1C at the foremost stage is a mechanical booster pump including a single pump chamber 21C in the casing. The vacuum exhaust device 1C is connected to a device to be exhausted such as a vacuum chamber (not, shown).

The vacuum exhaust devices 1D and 1E at the stages subsequent to the foremost stage are each a multistage roots vacuum pump and each include a plurality of pump chambers. Further, the vacuum exhaust devices 1D and 1E each include a plurality of intake ports and exhaust ports for the plurality of pump chambers. That is, the plurality of pump chambers constituting the vacuum exhaust device 1D (1E) of this embodiment are not connected such that all the pump chambers are connected in series.

In other words, at least two of the plurality of pump chambers are not connected to another pump chamber formed in the same casing. Further, those pump chambers are each provided with both an intake port and an exhaust port.

A pump chamber 21D of the vacuum exhaust device 1D is not connected to the other pump chambers 22D and 23D in the same vacuum exhaust device 1D and is connected to a pump chamber 21E of the vacuum exhaust device 1E via an exhaust port 41D that directly communicates with the pump chamber 21D.

Further, the vacuum exhaust device 1D and the vacuum exhaust device 1E directly communicate with each other on the plane denoted by reference symbol J without using a pipe or the like.

Furthermore, the vacuum exhaust system 10B includes a connection unit 7 (manifold) that supplements connection among the vacuum exhaust devices 1. The connection unit 7 is divided into an intake-side-path-forming member (first connection member) 71, a base unit 72 as an exhaust-side-path-forming member (second connection member), a pipe member 73, and a valve unit 74 (valve assembly). Those are combined with the vacuum exhaust devices 1C to 1E, and thus a connection pipe that connects the plurality of pump chambers constituting the vacuum exhaust devices 1C to 1E is completed, thus functioning as the vacuum exhaust system 10B.

The intake-side-path-forming member 71 is a block-shaped member arranged in between the vacuum exhaust device 1C and the vacuum exhaust device 1D. In the intake-side-path-forming member 71, a path 75 (see FIG. 8) that connects the pump chamber 21C of the vacuum exhaust device 1C and the pump chamber 21D of the vacuum exhaust device 1D is formed, and an intake-side path (connection path) 76 (see FIG. 9) that connects the pipe member 73 and the pump chambers 22D and 23D of the vacuum exhaust device 1D is formed. The pipe member 73 is connected to a side portion of the intake-side-path-forming member 71, and a pipe path 78 formed within the pipe member 73 is connected to the intake-side path 76. The intake-side path 76 is constituted of two paths as denoted by reference symbols 76*a* and 76*b* of FIG. 8.

Figure 12:
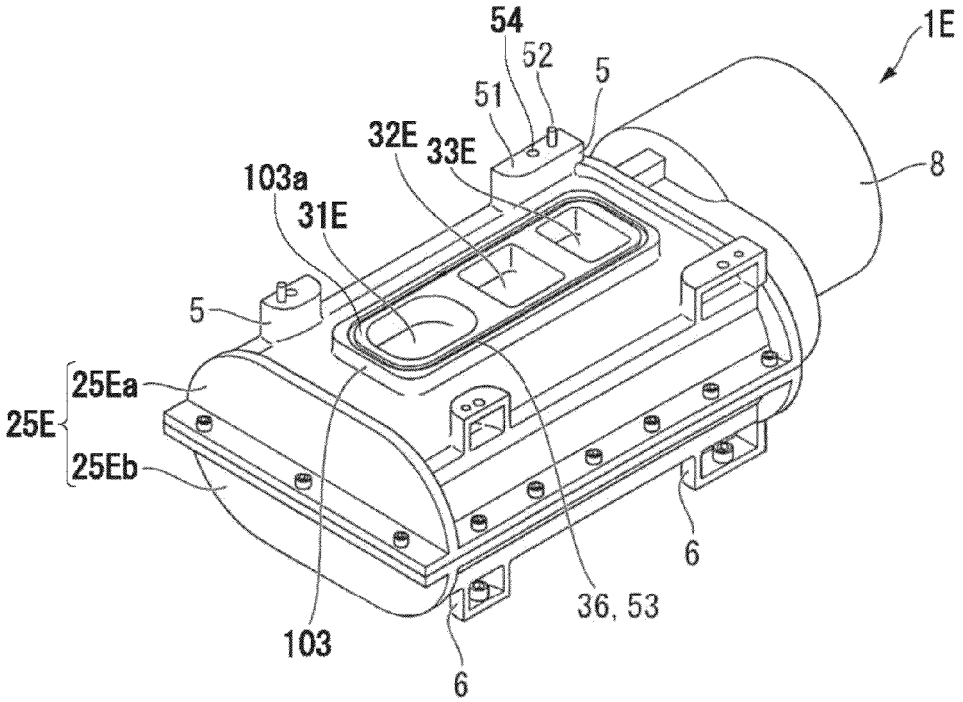
FIG. 12 is a perspective view of a vacuum exhaust device as viewed from above.
Figure 13:
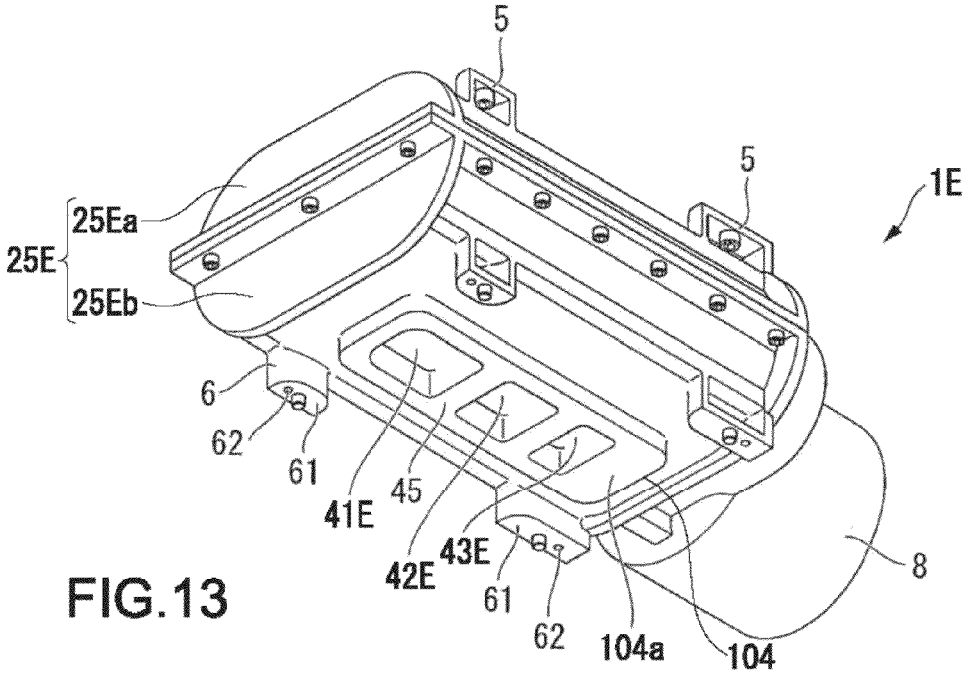
FIG. 13 is a perspective view of the vacuum exhaust device shown in FIG. 12 as viewed from below.

FIG. 12 is a perspective view of the vacuum exhaust device 1E (that may be 1D) as viewed from above. FIG. 13 is a perspective view of this vacuum exhaust device as viewed from below. A casing of the vacuum exhaust device 1E has a vertically dual-partitioning structure as described above and includes an upper-side casing 25Ea and a lower-side casing 25Eb. An intake unit 103 is provided to the upper-side casing 25Ea (see FIG. 12), and an exhaust unit 104 is provided to the lower-side casing 25Eb. An O-ring 53 is fitted to an end surface 103*a* of the intake unit 103, and in addition thereto, a gasket (not shown) is applied to the end surface 103*a* of the intake unit 103. The gasket is a sealing member for blocking communication of adjacent intake ports 31E, 32E, and 33E with one another.

At the time of manufacture of this vacuum exhaust system 10B, for example, after a paste-like gasket is applied to the end surface 103*a* of the intake unit 103, the end surface 103*a* of the casing 25E comes into contact with an end surface of an exhaust unit of the casing of the vacuum exhaust device 1D so that those are connected to each other. As a material of the gasket, corrosive-resistant rubber made of silicon-based or fluorine-based rubber is used, but the material is not limited thereto.

By use of a simple sealing member such as a coating-type gasket in this way, it is possible to reduce costs and ensure the intake ports 31E, 32E, and 33E each having as large an opening area as possible within the small intake unit 103. Even when a simple sealing member is used in this way and gas leaks between adjacent intake ports, there is no problem if the leakage occurs at a leak speed, sufficiently small with respect to an exhaust speed.

In the description above, the example in which the gasket is applied to the end surface 103*a* of the intake unit 103 has been described. However, as a matter of course, the gasket may be applied to the end surface 104*a* of the exhaust unit 104.

For example, in the case where the flatness of the end surfaces 103*a* and 104*a* is high, if the leakage speed of gas is sufficiently small, the coating-type gasket is unnecessary.

The base unit 72 is arranged so as to be connected to the bottom surface, that is, a lower portion of the vacuum exhaust device 1E and is connected to the pump chambers constituting the vacuum exhaust system 1E, the pipe member 73, and the valve unit 74. The pump chamber of the vacuum exhaust device 1C and the pipe member 73 are connected to the base unit 72, and an exhaust-side path (connection path) 77 (see FIG. 9) that connects the pump chambers of the vacuum exhaust device 1E and the valve unit 74 is formed in the base unit 72. There is provided a structure in which the vacuum exhaust device 1E, the pipe member 73, and the valve unit 74 are each connected to an upper surface of the base unit 72, and the base unit 72 supports the whole vacuum exhaust system 10B.

The exhaust-side path 77 includes three paths including two paths 77*a* and 77*b* (see. FIG. 8) connected to the pipe path 78 of the pipe member 73, and a path 77*c* that connects an exhaust port 43E and the valve unit 74, the exhaust port 43E communicating with a pump chamber 24E of the vacuum exhaust device 1E.

The pipe member 73 is a pipe-shaped member, and on the inside thereof, the above-mentioned pipe path 78 that connects the exhaust port of the vacuum exhaust device 1E and the intake port of the vacuum exhaust device 1D is formed. The pipe path 78 is divided into two by a division plane along the longitudinal direction, in accordance with two paths corresponding to the paths 76*a* and 76*b* (see FIG. 8) of the intake-side-path-forming member 71.

Figure 10:
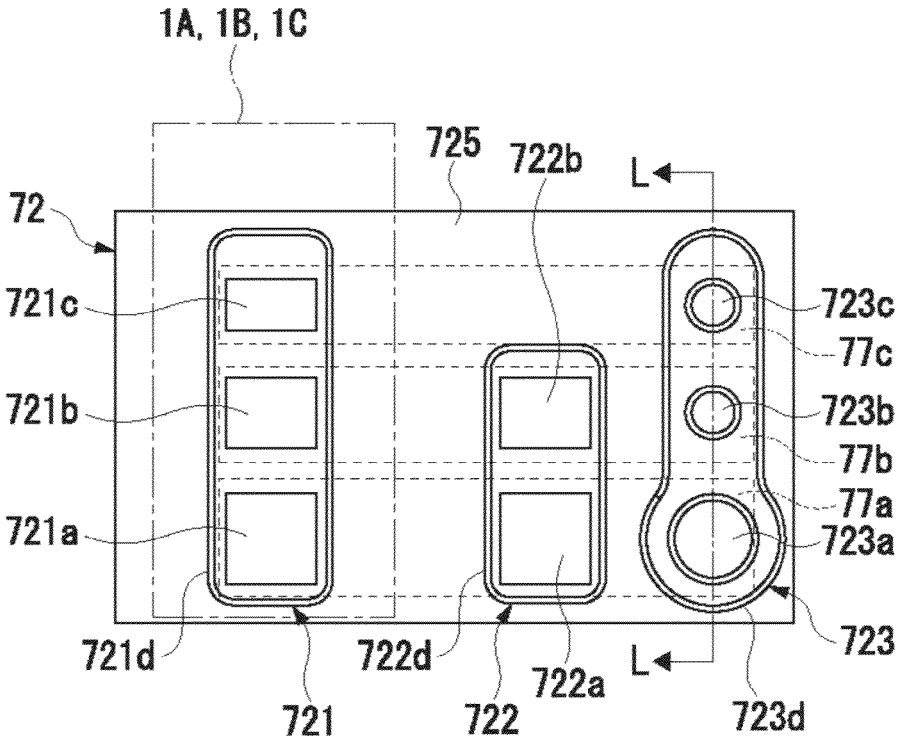
FIG. 10 is a cross-sectional view of a base unit as viewed from, above.
Figure 11:
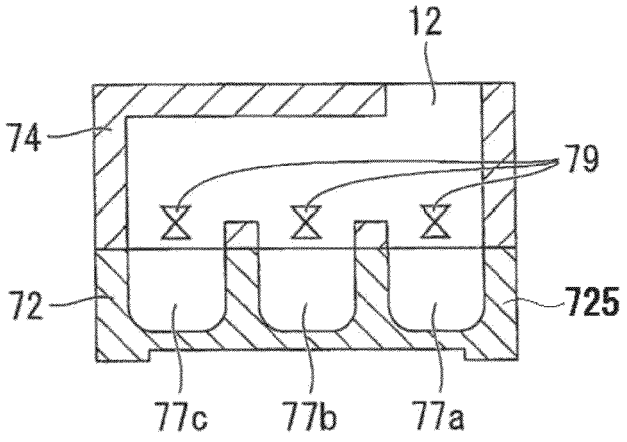
FIG. 11 is a cross-sectional view taken along the line L-L of FIG. 10.

FIG. 10 is a cross-sectional view of the base unit 72 as viewed, from above. FIG. 11 is a cross-sectional view taken along the line L-L of FIG. 10. On an upper surface of a block 725 of the base unit 72, a pump connection unit 721 connected to the casing of the vacuum exhaust device 1E, a pipe connection unit 722 connected to the pipe member 73, and a valve unit connection unit 723 connected to the valve unit 74 are formed. Seal members 721*d*, 722*d*, and 723*d* such as an O-ring are fitted into annular grooves formed at the circumferences of those pump connection unit 721, pipe connection unit 722, and valve unit connection unit 723, respectively.

In the pump connection unit 721, three communication ports 721*a*, 721*b*, and 721*c* are formed to be arrayed. Those three communication ports 721*a*, 721*b*, and 721*c* communicate with exhaust ports 41E, 42E, and 43E of the vacuum exhaust device 1E, respectively. In the pipe connection unit 722, two communication ports 722*a* and 722*b* are formed and communicate with the pipe path 78 of the pipe member 73. Further, in the valve unit connection unit 723, three communication ports 723*a*, 723*b*, and 723*c* are formed to be arrayed.

All of the communication ports 721*a*, 722*a*, and 723*a* communicate with the path 77*a* of the exhaust-side path 77. All of the communication ports 721*b*, 722*b*, and 723*b* communicate with the path 77*b* of the exhaust-side path. All of the communication ports 721*c* and 723*c* communicate with the path 77*c* of the exhaust-side path. Those configurations are easy to understand also with reference to FIG. 9.

The valve unit 74 includes a whole exhaust port 12 that is an exhaust port of the whole vacuum exhaust system 10B. As shown in the cross-sectional view of FIG. 11, the valve unit 74 is provided with a plurality of valves 79 (check valves). Thus, among the pump chambers 21E, 22E, and 24E constituting the vacuum exhaust device 1E and directly connected to the exhaust ports 41E, 42E, and 43E, respectively, gas can be exhausted from an arbitrary pump chamber individually.

The valve unit 74 is provided, and therefore it is possible to prevent excessive compression by the pumps and suppress a loss of power transmission by the motor 8.

Each of the plurality of valves 79 may have a ball shape or may be an adjustment valve capable of adjusting a pressure to an individual value. In the case where each of the valves 79 is an adjustment valve capable of adjustment to an individual pressure, the pressure can be set as appropriate, and a pressure range to be used by a user can be widened.

In this, way, the base unit 72 and the valve unit 74 are arranged at a lower portion of the vacuum exhaust device 1E at the last stage, that is, arranged at the lowermost portion of the vacuum exhaust system 10B. Thus, it is possible to arrange the center of gravity of the vacuum exhaust system 10B as low as possible and to increase stability when the vacuum exhaust system 10B of the vertically stacked multi-stage is installed.

Next, with reference to FIG. 8, description will be given on the configuration of the plurality of pump chambers constituting each vacuum exhaust device in this embodiment and a connection order of the pump chambers.

The vacuum exhaust device 1C located at the uppermost stage is a mechanical booster pump including one pump chamber 21C, and the pump chamber 21C includes the intake port 11 and the exhaust port 41C.

The vacuum exhaust device 1D includes the three pump chambers 21D, 22D, and 23D. The three pump chambers 21D, 22D, and 23D include the three intake ports 31D, 32D, and 33D and three exhaust ports 41D, 42D, and 43D described above.

The vacuum exhaust device 1E includes the four pump chambers 21E, 22E, 23E, and 24E including the three intake ports 31E, 32E, and 33E and the three exhaust ports 41E, 42E, and 43E. Among the four pump chambers of the vacuum exhaust device 1E, two of the pump chambers 23E and 24E are directly connected to each other within the casing, constituting the vacuum exhaust device 1E via the connection pipe 29.

The connection unit 7 is configured such that the intake-side-path-forming member 71, the base unit 72, and the pipe member 73 work in cooperation with one another to connect the exhaust port 41E of the vacuum exhaust device 1E and the intake port 32D of the vacuum exhaust device 1D. Similarly, the connection unit 7 is configured such that the exhaust port 42E of the vacuum exhaust device 1E and the intake port 33D of the vacuum exhaust device 1D are connected.

Further, the connection unit 7 is configured such that the exhaust port 43E of the vacuum exhaust device 1E and the valve unit 74 are connected.

Next, with reference to FIG. 8, an actual flow of gas will be described.

First, gas flowing from the intake port 11 into the vacuum exhaust device 1C is compressed in the pump chamber 21C and exhausted from the exhaust port 41C. Next, the gas flows in the pump chamber 21D of the vacuum exhaust device 1D and is compressed. Then, the gas flows in the pump chamber 21E of the vacuum exhaust device 1E directly connected to the pump chamber 21D. The gas exhausted, from the pump chamber 21E flows in the path 77*a* of the exhaust-side path 77 formed in the base unit 72. The gas flow described above is indicated by the arrow F1 of FIG. 8.

Figure 9:
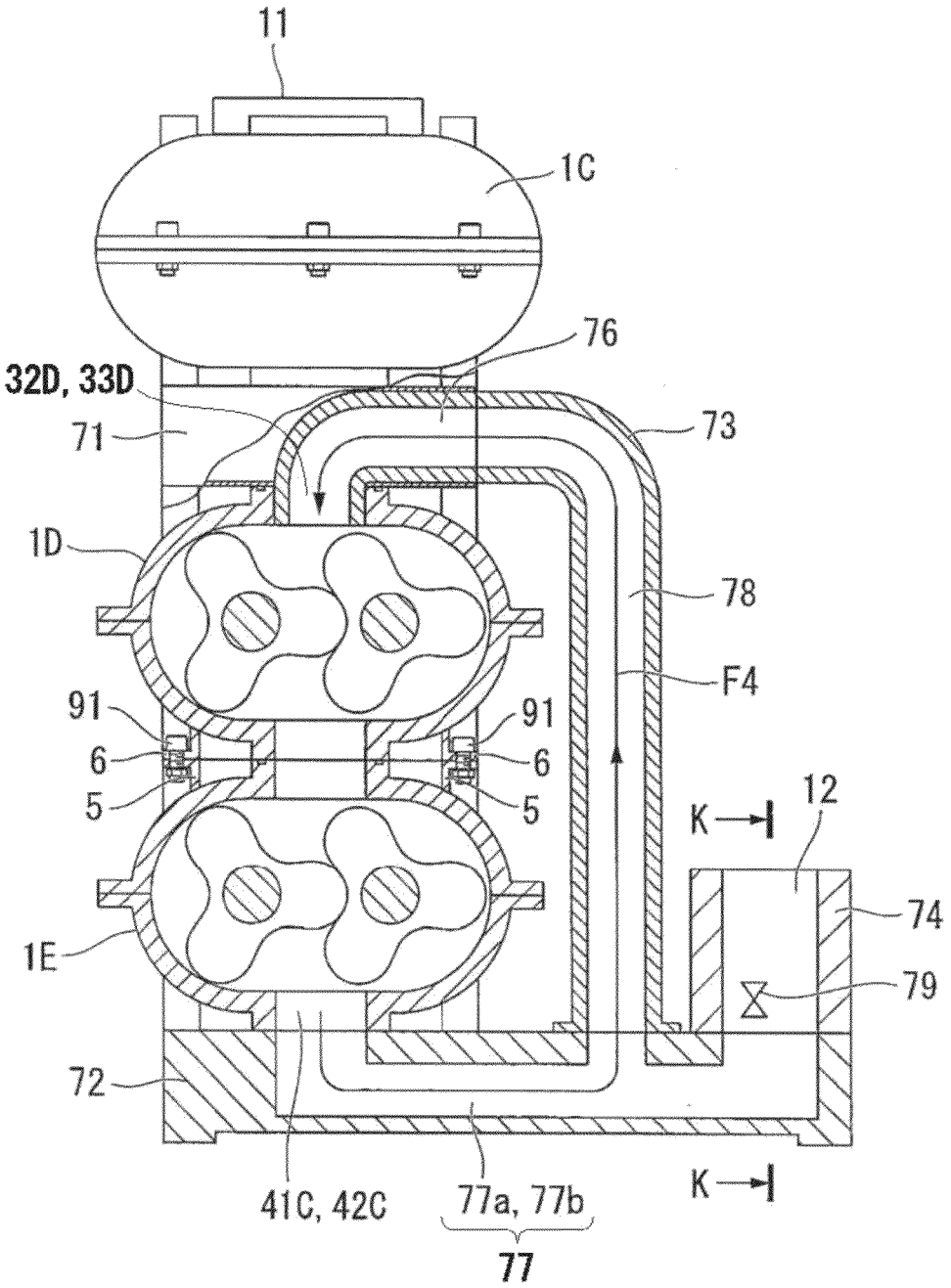
FIG. 9 is a side view of the vacuum exhaust system as viewed in an H direction of FIG. 7.

The gas that has flowed in the base unit 72 flows in the pump chamber 22D of the vacuum exhaust device 1D via the pipe member 73. FIG. 9 shows a flow (arrow F4) in which the gas is returned to another pump chamber of the vacuum exhaust device 1D from the base unit 72 via the pipe member 73.

The gas that has flowed in the pump chamber 22D is compressed in a path reaching the base unit 72 as indicated by the arrow F2 shown in FIG. 8. Then, the gas that has been compressed in the path indicated by the arrow F3 shown in FIG. 8 is eventually introduced to the valve unit 74 and exhausted from the exhaust port 12.

Further, by operation of the plurality of valves 79 provided to the valve unit 74, exhaust from the pump chamber 21E or 22E of the vacuum exhaust device 1E is allowed.

According to the embodiment described above, provided is a configuration in which the intake ports 32D and 33D of the vacuum exhaust device 1D arranged at one end side among the plurality of connected vacuum exhaust devices and the exhaust ports 41E and 42E of the vacuum exhaust device 1E arranged at the other end side are connected to each other, and thus gas exhausted from the vacuum exhaust device 1E arranged at the other end side is caused to flow in the vacuum exhaust device 1D arranged at the one end side.

Accordingly, when a plurality of vacuum exhaust devices including a plurality of pump chambers are connected to compress gas, the degree of freedom in arrangement of the pump chambers is increased. Therefore, in addition to the effects of the first embodiment, a more efficient vacuum exhaust system can be established.

Further, by direct connection of the valve unit 74 to the base unit 72, exhaust from an arbitrary pump chamber is easily performed. Therefore, it is unnecessary to provide complicated pipe connection and it is possible to achieve compatibility between optimization and downsizing of devices.

Third Embodiment

Figure 14:
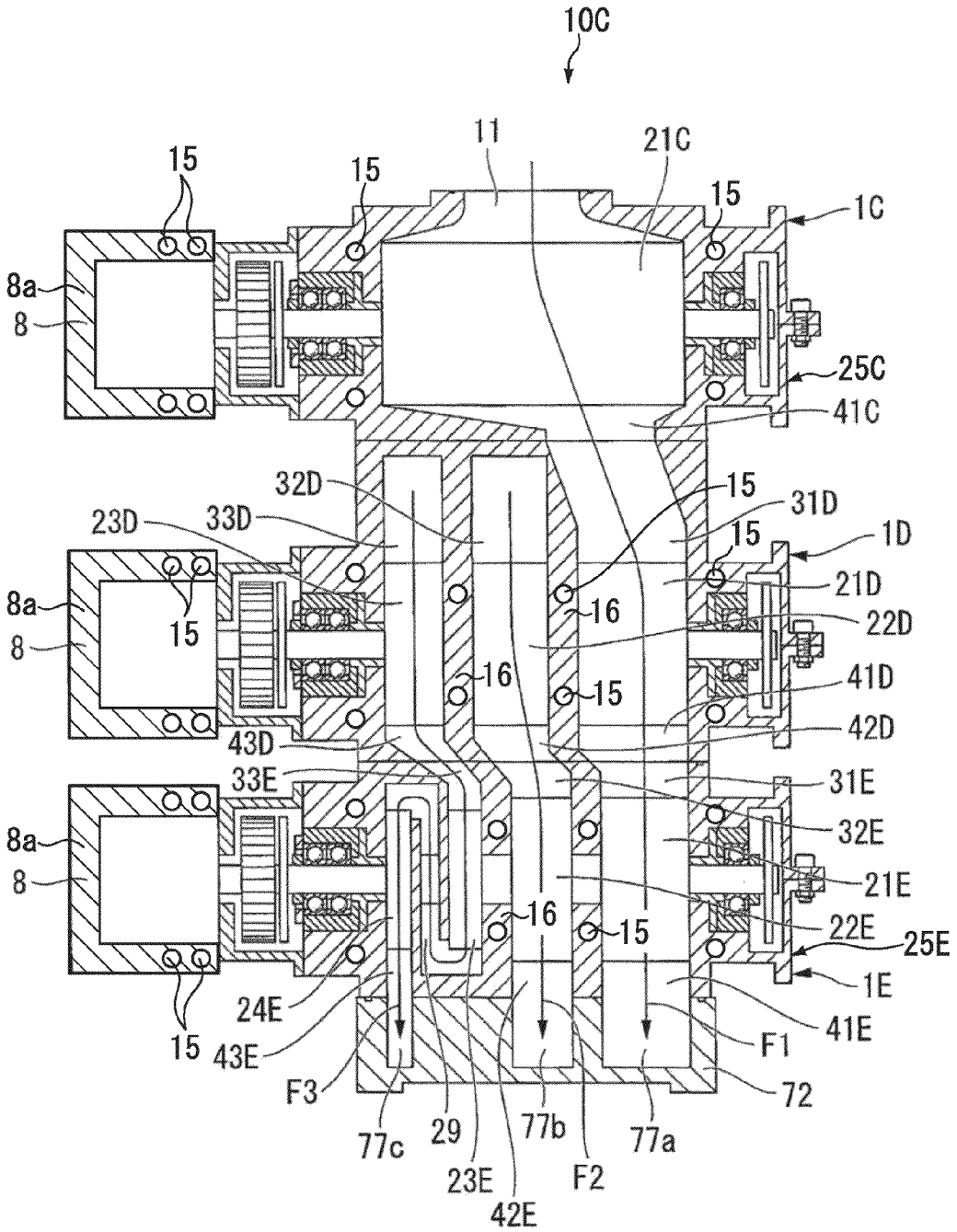
FIG. 14 is a cross-sectional view showing a vacuum exhaust system according to a third embodiment of the present invention.
Figure 15:
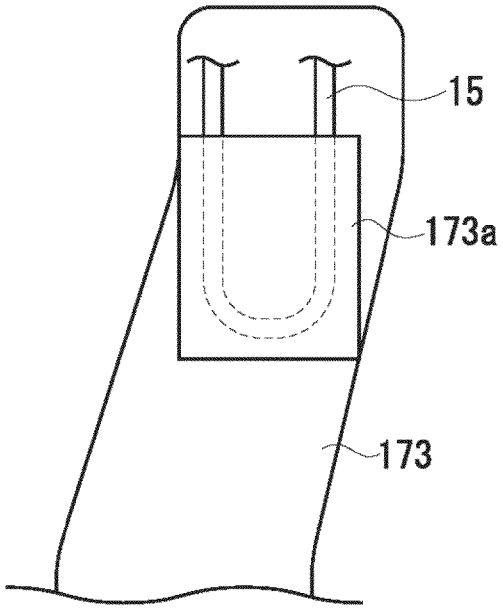
FIG. 15 is a side view of a pipe member constituting a part of a connection unit of the vacuum exhaust system.

FIG. 14 is a cross-sectional view showing a vacuum exhaust system according to a third embodiment of the present invention. FIG. 15 is a side view showing a part of a connection unit of the vacuum exhaust system as viewed in a direction perpendicular to a rotating shaft of a rotor of each vacuum exhaust device. A vacuum exhaust system 10C according to this embodiment and, for example, the vacuum exhaust system 10B according to the second embodiment described above are different from each other in that the vacuum exhaust system 10C includes a cooling mechanism.

The cooling mechanism is a cooling pipe 15 that causes a cooling medium to flow therethrough, for example. The cooling pipes 15 are provided at a plurality of positions of each of casings 25C, 25D, and 25E of the vacuum exhaust system 10C, in motor housings 8*a* of motors 8, and also in a pipe member 173 as shown in FIG. 15. The cooling pipes 15 provided to the casings 25C, 25D, and 25E are provided near a bearing and provided so as to be inserted into a partition wall 16 or the like, for example. In the vacuum exhaust device 1D (1E), the partition wall 16 has a function of defining a plurality of pump chambers 21D to 23D (21E to 23E) within one casing 25D (25E). Such a cooling mechanism allows the vacuum exhaust system 10C to be efficiently cooled.

In particular, the cooling pipe 15 is provided to the partition wall 16, and therefore a casing, which is hard to cool, can be cooled to the inside thereof.

As shown in FIG. 15, a holding box 173*a* that holds a part of the cooling pipe 15 is connected to a side surface of the pipe member 173. The cooling pipe 15 is formed into such a U-shape that is turned once within the holding box 173*a*. However, the cooling pipe 15 is not limited to the U-shape, and the designing of the shape or length thereof can be changed.

It should be noted that the cooling pipes 15 provided at a plurality of positions as described above may be configured so as to be connected by one pipe having one inlet and one outlet, that is, configured as a flow path of one system. Alternatively, the cooling pipes 15 may be constituted of a plurality of pipes so as to be configured as flow paths of a plurality of systems.

Fourth Embodiment

Figure 16:
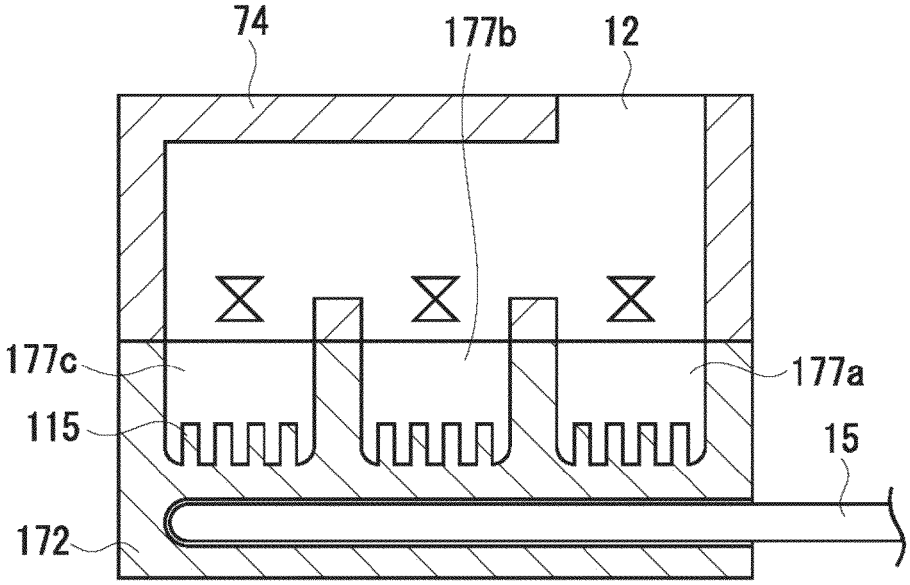
FIG. 16 is a view for describing a cooling mechanism provided to a vacuum exhaust system according to a fourth embodiment of the present invention.

FIG. 16 is a view for describing a fourth embodiment of the present invention and is a cross-sectional view showing a structure of a part of a vacuum exhaust system. This is a base unit 172 in which a cooling mechanism is added to the base unit 72 according to the second embodiment described above.

This cooling mechanism includes, in addition to the cooling pipes 15, cooling fins 115 provided to exhaust-side paths 177*a*, 177*b*, and 177*e*. The cooling fins 115 are formed in a block of the base unit 172 by integral molding, for example. The cooling pipes 15 are arranged at lower portions of those exhaust-side paths 177*a*, 177*b*, and 177*c* and provided to pass through the block of the base unit 172.

In the vacuum exhaust system, since gas is compressed on the exhaust side, temperature rises on the exhaust side more than on the intake side. The cooling mechanism is provided to the base unit on the exhaust side of the vacuum exhaust system, and therefore heat generated by compression of gas can be cooled efficiently.

In this embodiment, the cooling fins 115 are provided as the cooling mechanism, but the cooling fins 115 may not be provided.

The present technology is not limited to the embodiments described above and can achieve other various embodiments.

The outer shape of the casing 25 is not limited to the elliptical cylinder shape. In particular, the outer shape may be a shape that does not depend on the shape of a pump chamber, for example, a block shape as long as a vacuum pump has a small amount of displacement.

In the embodiments described above, the plurality of vacuum exhaust devices are arranged to be stacked on each other in the vertical direction, but vacuum exhaust devices may be stacked on each other in a horizontal direction or both in the vertical and horizontal directions.

The vacuum exhaust systems according to the embodiments described above each include two or three vacuum exhaust devices, but the vacuum exhaust system may include four or more vacuum exhaust devices arrayed and connected in the vertical and/or horizontal direction(s).

As described above, in the case where the second (third, or fourth) embodiment described above is applied to an embodiment in which three ore more or four or more vacuum exhaust devices are provided, a pipe member having a function of an outer pipe, such as the pipe member 73, may be connected such that casings of adjacent two vacuum exhaust devices among those four or more vacuum exhaust devices are connected to each other. Alternatively, a pipe member having a function of an outer pipe, such as the pipe member 73, may be connected such that casings of non-adjacent two vacuum exhaust devices among those four or more vacuum exhaust devices are connected to each other.

In the case where a vacuum exhaust system includes four or more vacuum exhaust devices, for example, a plurality of pipe members having a function of an outer pipe, such as the pipe member 73, may be provided.

The cooling mechanism shown in FIG. 16 may be provided between, for example, the vacuum exhaust device 1C at the foremost stage and the vacuum exhaust device 1D at the next stage as shown in FIG. 8 or 14.

The cooling fins provided in the cooling mechanism as shown in FIG. 16 may be formed in the partition wall 16 described above.

DESCRIPTION OF SYMBOLS

1A to 1E vacuum exhaust device
3, 103 intake unit
3*a*, 103*a* end surface
4, 104 exhaust unit
4*a*, 104*a* end surface
5 mount portion
6 leg portion
21 to 24 pump chamber
25A, 25B casing
25Ba, 25Ea upper-side casing
25Bb, 25Eb lower-side casing
31 to 33 intake port
41 to 43 exhaust port
51 first end surface
52 protrusion portion (positioning mechanism)
53 sealing member
61 second end surface
62 positioning hole (positioning mechanism)

The invention claimed is:

1. A coupling structure for a plurality of vacuum exhaust devices, each of the vacuum devices including a pump chamber and a casing that encases the pump chamber, and each of the vacuum exhaust devices including a motor connected to the casing, the coupling structure comprising:

a first end surface formed on a first side of the casing;

a second end surface formed on a second side of the casing, the second side being an opposite side of the first side;

a plurality of mount portions each including the first end surface and each being formed on the first side of the casing; and a plurality of leg portions each including the second end surface and each being formed on the second side of the casing, wherein a casing of a first vacuum exhaust device and a casing of a second vacuum exhaust device among the plurality of vacuum exhaust devices are arranged to be directly superposed on each other such that the second end surface provided to the first vacuum exhaust device and the first end surface provided to the second vacuum exhaust device come into contact with each other, and wherein by fastening the first end surface of the second vacuum exhaust device and the second end surface of the first vacuum exhaust device, the first vacuum exhaust device and the second vacuum exhaust device are connected to each other such that gas flows between the casing of the first vacuum exhaust device and the casing of the second vacuum exhaust device.

2. The coupling structure according to claim 1, wherein the plurality of vacuum exhaust devices each include an intake unit including at least one intake port and an intake unit end surface, the at least one intake port communicating with the pump chamber, the intake unit being formed on the first side of the casing, and an exhaust unit including at least one exhaust port and an exhaust unit end surface, the at least one exhaust port communicating with the pump chamber, the exhaust unit being formed on the second side of the casing, the casing of the first vacuum exhaust device and the casing of the second vacuum exhaust device are arranged to be directly superposed on each other such that the intake unit end surface of the intake unit and the exhaust unit end surface of the exhaust unit come into contact with and overlap each other, and by fastening the first end surface and the second end surface, the intake unit end surface and the exhaust unit end surface are directly connected to each other and the intake port and the exhaust port communicate with each other.

3. The coupling structure according to claim 2, wherein the plurality of mount portions and the intake unit are independently formed on the casing, and the plurality of leg portions and the exhaust unit are independently formed on the casing.

4. The coupling structure according to claim 3, wherein the intake unit end surface of the intake unit and the plurality of mount portions are formed on the same plane, and the exhaust unit end surface of the exhaust unit and the plurality of leg portions are formed on the same plane.

5. The coupling structure according to claim 2, further comprising a sealing member provided to the intake unit end surface or the exhaust unit end surface, the sealing member keeping air sealing inside the casing.

6. The coupling structure according to claim 1, further comprising a positioning mechanism provided to the first end surface of each of the plurality of mount portions or the second end surface of each of the plurality of leg portions, the positioning mechanism having a concavo-convex shape.

7. The coupling structure according to claim 1, wherein the casing is formed of a lower-side casing and an upper-side casing.

* * * * *